US009806467B2

(12) United States Patent
Long

(10) Patent No.: US 9,806,467 B2
(45) Date of Patent: Oct. 31, 2017

(54) ELECTRICAL CONNECTOR ASSEMBLY HAVING A METAL URGING MEMBER

(71) Applicant: LOTES CO., LTD, Keelung (TW)

(72) Inventor: Quan Long, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/077,160

(22) Filed: Mar. 22, 2016

(65) Prior Publication Data

US 2016/0352049 A1 Dec. 1, 2016

(30) Foreign Application Priority Data

May 25, 2015 (CN) ..... 2015 2 0340608 U

(51) Int. Cl.

| | |
|---|---|
| ***H01R 13/659*** | (2011.01) |
| *H01R 13/6594* | (2011.01) |
| *H01R 13/6587* | (2011.01) |
| *H01R 13/6586* | (2011.01) |
| *H01R 13/518* | (2006.01) |
| *H01R 12/50* | (2011.01) |
| *H01R 24/60* | (2011.01) |

(52) U.S. Cl.

CPC ..... *H01R 13/659* (2013.01); *H01R 13/518* (2013.01); *H01R 13/6586* (2013.01); *H01R 13/6587* (2013.01); *H01R 13/6594* (2013.01); *H01R 23/7073* (2013.01); *H01R 24/60* (2013.01)

(58) Field of Classification Search

CPC ..... H01R 13/518; H01R 13/659; H01R 13/6594; H01R 13/6586; H01R 13/6587; H01R 23/7073

USPC ..... 439/541.5, 540.1, 607.4, 607.23

See application file for complete search history.

(56) References Cited

U.S. PATENT DOCUMENTS 7,048,550 B2 * 5/2006 Hyland ..... H01R 31/005 439/540.1

2007/0243757 A1 * 10/2007 Wan ..... H01R 27/02 439/541.5

* cited by examiner

*Primary Examiner* — Abdullah Riyami
*Assistant Examiner* — Justin Kratt
(74) *Attorney, Agent, or Firm* — Locke Lord LLP; Tim Tingkang Xia, Esq.

(57) ABSTRACT

An electrical connector assembly includes an insulating body provided with an accommodating cavity, a metal member retained to the outside of the insulating body, and a first connector disposed in the accommodating cavity. The accommodating cavity has two opposite side walls. The metal member has two side plates and two urging portions respectively connected to the two side plates. The urging portions are disposed in the accommodating cavity. Each of the side walls is disposed between the corresponding urging portion and the corresponding side plate. The first connector has a first metal casing. Each of the urging portions urges the first metal casing, and each of the urging portions is located between the first metal casing and the corresponding side wall.

16 Claims, 5 Drawing Sheets

ELECTRICAL CONNECTOR ASSEMBLY HAVING A METAL URGING MEMBER

CROSS-REFERENCE TO RELATED APPLICATIONS

This non-provisional application claims priority to and benefit of, under 35 U.S.C. §119(a), Patent Application No. 201520340608.9 filed in P.R. China on May 25, 2015, the entire content of which is hereby incorporated by reference.

FIELD OF THE INVENTION

The present invention relates generally to an electrical connector assembly, and more particularly to an electrical connector assembly having a metal member.

BACKGROUND OF THE INVENTION

The background description provided herein is for the purpose of generally presenting the context of the present invention and is neither expressly nor impliedly admitted as prior art against the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

In paragraph [0033] of the specification of Chinese Patent Application Publication No. CN201010506577.1, a shielding cover, a shielding casing and a substrate module are disclosed, where a pair of contact portions in a plate shape extends from end portions at lower ends of two side wall portions. Each of the contact portions is folded back from a top plate portion. An end portion of the contact portion is bent toward the inner side into a rough V shape. A distance between the tops of the end portions is less than a distance between outer side surfaces of a casing body of a metal casing. Therefore, when the casing body of the metal casing is inserted between the end portions of the contact portions, the tops of the end portions of the contact portions elastically contact two outer side surfaces of the casing body of the metal casing and are sandwiched between the two outer side surfaces. Therefore, grounding communication is achieved between the contact portions and the metal casing.

This contact portion structure disclosed in the above patent application is easily deformed toward a corresponding side wall portion, which affects grounding performance of the contact portion; and after the contact portions are subject to a force, elastic fatigue is easily generated or the contact portions are broken because the force is excessively violent, thereby causing poor contact between the contact portions and the two outer side surfaces of the casing body of the metal casing, so that product quality is deteriorated and the grounding performance is not good.

Therefore, a heretofore unaddressed need exists in the art to address the aforementioned deficiencies and inadequacies.

SUMMARY OF THE INVENTION

In one aspect, the present invention relates to an electrical connector assembly that is not easily deformed, provides stable contact, and has high quality and good grounding performance.

In one embodiment, an electrical connector assembly includes an insulating body having an accommodating cavity, a metal member retained to the outside of the insulating body, and a first connector disposed in the accommodating cavity. The accommodating cavity has two opposite side walls. The metal member has two side plates and two urging portions respectively connected to the two side plates. The urging portions are disposed in the accommodating cavity, and each of the side walls is disposed between the corresponding urging portion and the corresponding side plate. The first connector has a first metal casing. The urging portions urge the first metal casing, and each of the urging portion is located between the corresponding first metal casing and the corresponding side wall.

In one embodiment, each of the side walls is provided with a notch, and each of the urging portions bypasses the corresponding notch and is bent, and extends into the accommodating cavity.

In one embodiment, the metal member is provided with a front plate and two side plates connected to two sides of the front plate, and each of the urging portions extends from the corresponding side plate and bypasses the corresponding side wall to enter the accommodating cavity.

In one embodiment, each of the urging portions extends downward from the corresponding side plate and is reversely bent into the accommodating cavity.

In one embodiment, a grounding pin extends downward from each of the side plates, and a gap exists between the corresponding grounding pin and the corresponding urging portion.

In one embodiment, a first buckling portion and a second buckling portion are disposed on each of the side plates, and the insulating body is provided with a first snap-fit slot and a second snap-fit slot that correspond to each of the first buckling portions and each of the second buckling portions.

In one embodiment, each of the first buckling portions is connected to the corresponding grounding pin, and each of the first buckling portions and the corresponding urging portion are located at a same height.

In one embodiment, each side surfaces of the insulating body is provided with a groove, and each of the side plates is located in the corresponding groove.

In another aspect, the present invention relates to an electrical connector assembly. In one embodiment, an electrical connector includes an insulating body and a metal member disposed at the outer side of the insulating body. The insulating body at least has a first accommodating cavity and a second accommodating cavity. The first accommodating cavity and the second accommodating cavity accommodate a first metal casing and a second metal casing, respectively. The metal member is connected to the first metal casing and the second metal casing. The metal member has a front plate and side plates connected to two sides of the front plate. An urging portion extends downward from each of the side plates and is bent and extends from the outer side of the insulating body into the first accommodating cavity. Each of the urging portions urges a side of the first metal casing, and each of the urging portions is located between the first metal casing and the insulating body.

In one embodiment, the first accommodating cavity has two opposite side walls, each of the side walls is provided with a notch, and each of the urging portions extends downward from the corresponding side plate, bypasses the corresponding notch and is reversely bent into the first accommodating cavity.

In one embodiment, the first accommodating cavity has two opposite side walls, each of the urging portions extends downward from the corresponding side plate, passes through the corresponding side wall and is reversely bent into the first accommodating cavity.

In one embodiment, a contact portion extends from an upper side edge of the front plate into the second accommodating cavity, and the contact portion is in contact with the second metal casing.

In one embodiment, a grounding pin extends downward from each of the side plates, and a gap exists between each of the grounding pins and the corresponding urging portion.

In one embodiment, a first buckling portion and a second buckling portion are disposed on each of the side plates, and the insulating body is provided with a first locking slot and a second locking slot that correspond to the first buckling portion and the second buckling portion.

In one embodiment, the first buckling portion is connected to the corresponding grounding pin, and the first buckling portion and the corresponding urging portion are located at a same height.

In one embodiment, the front plate is located between the first metal casing and the second metal casing, and both the first metal casing and the second metal casing protrude forward from the front plate.

In one embodiment, each of side surfaces of two opposite sides of the insulating body is provided with a groove, and the side plates are respectively located in the grooves.

Compared with the related art, in the electrical connector assembly according to certain embodiment of the present invention, the urging portion is located between the side wall and the first metal casing, and the side wall plays a role of stopping the urging portion, so that after being subject to a force, the urging portion does not excessively approach in a direction toward the side plate, and is not easily deformed; and after the urging portion is subject to a force, the side wall pressing the urging portion, so that elastic fatigue does not easily occur in the urging portion, and therefore grounding performance of the urging portion is stable, so as to improve product quality.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
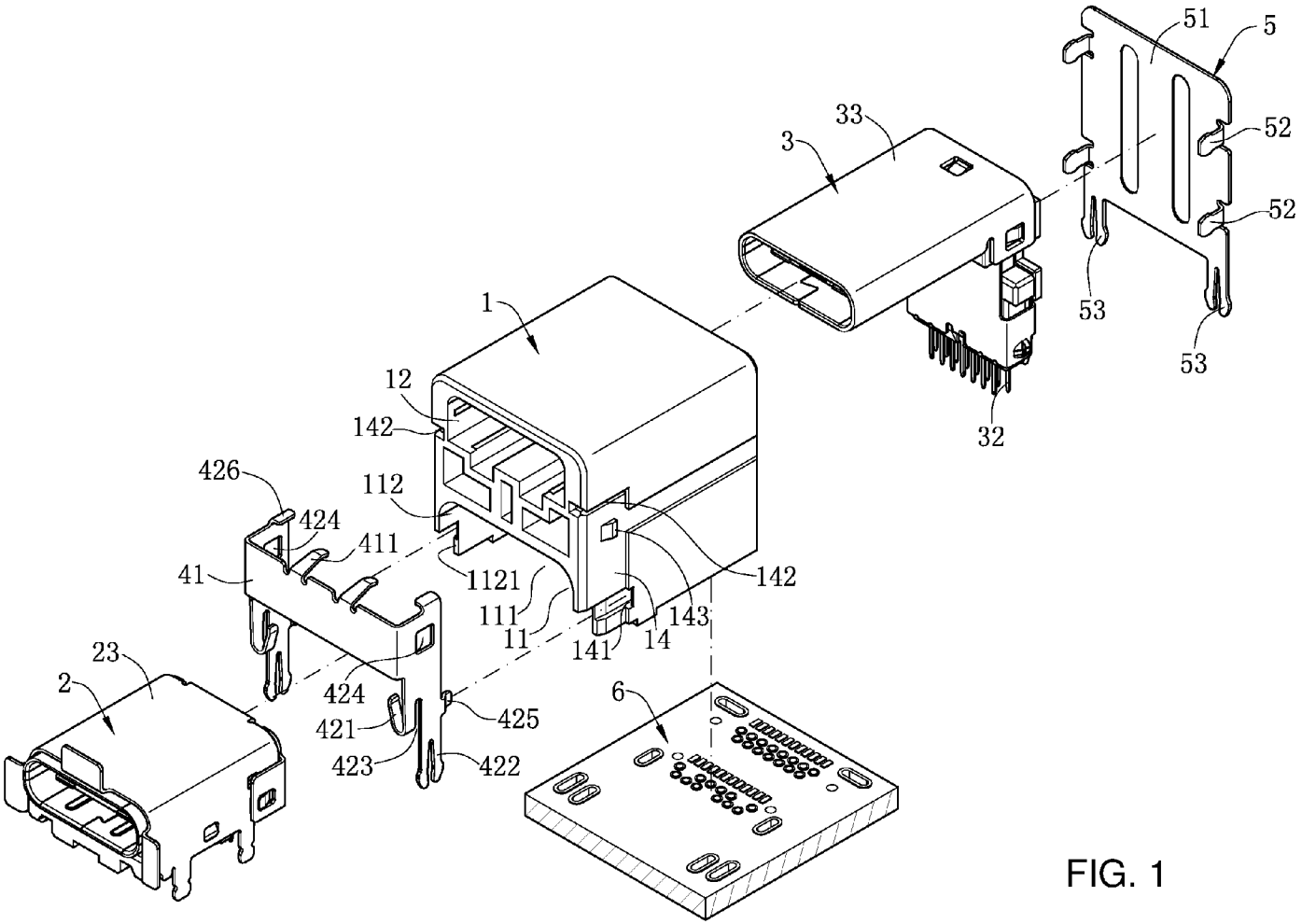
FIG. 1 is a schematic three-dimensional exploded view of an electrical connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

Figure 2:
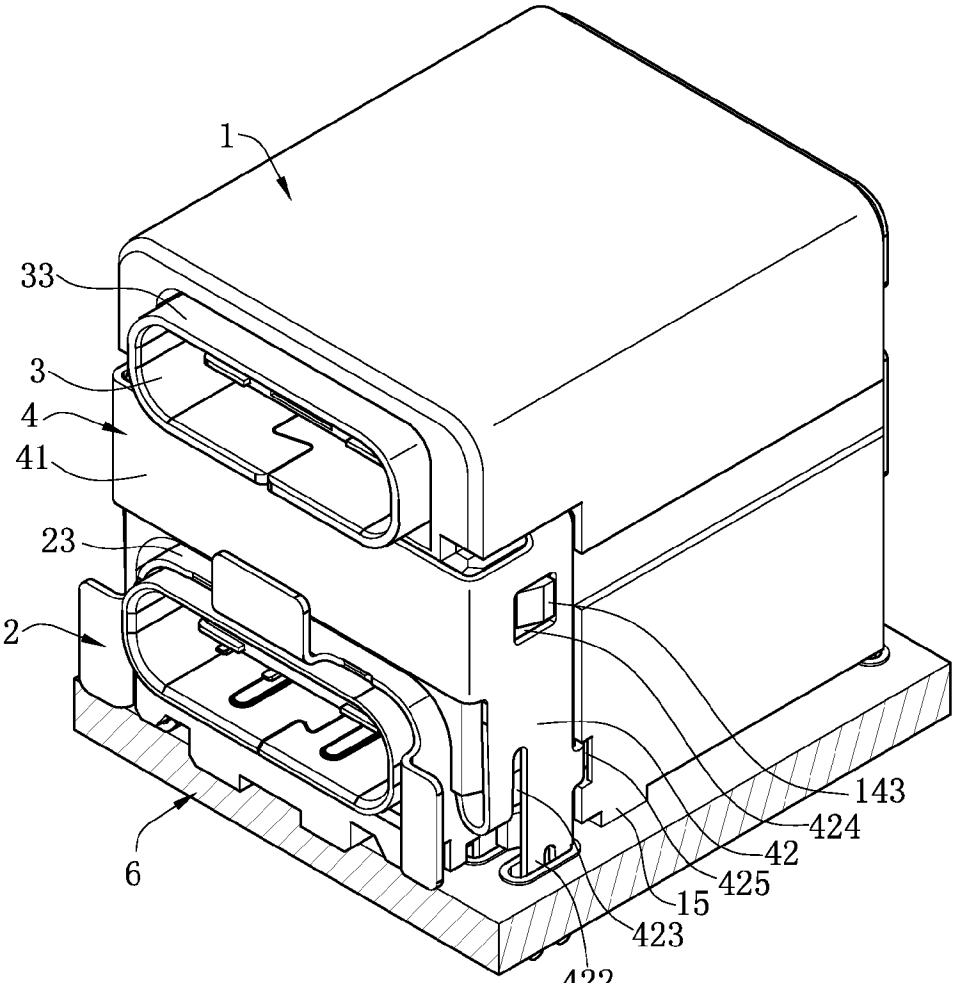
FIG. 2 is a schematic three-dimensional view of the electrical connector assembly according to one embodiment of the present invention.
Figure 3:
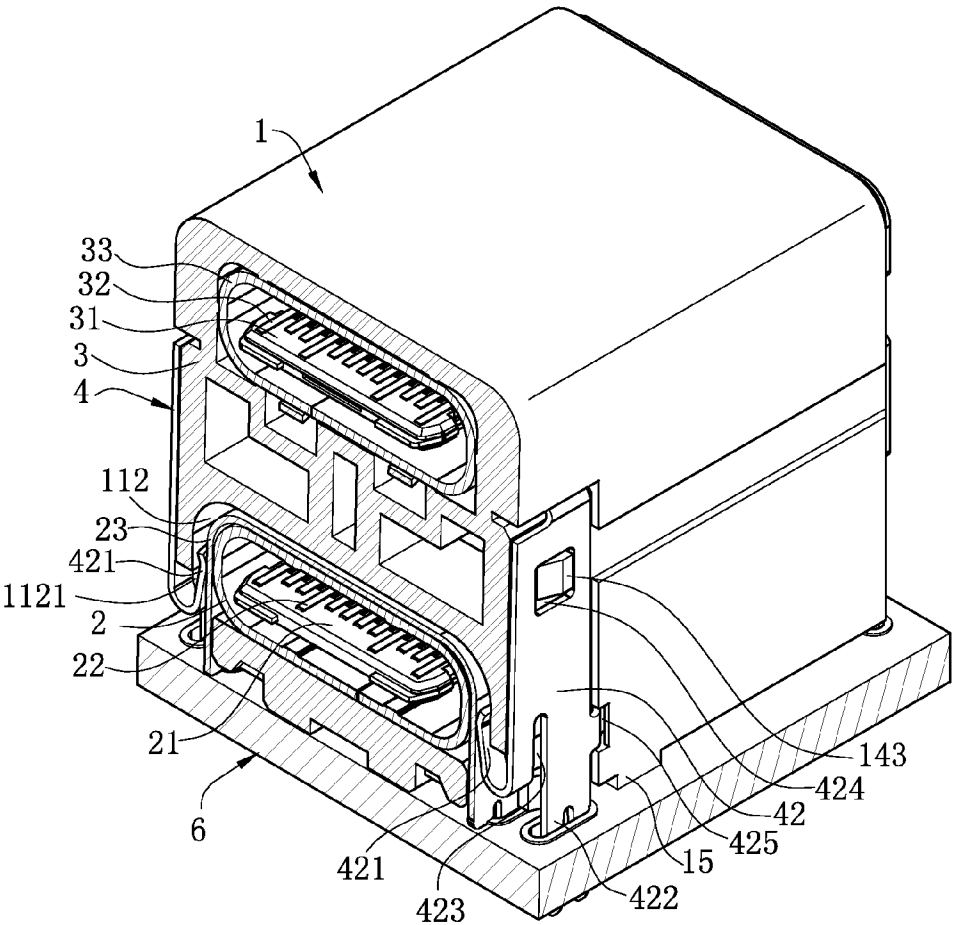
FIG. 3 is a partial sectional view of the three-dimensional view of the electrical connector assembly according to one embodiment of the present invention.
Figure 4:
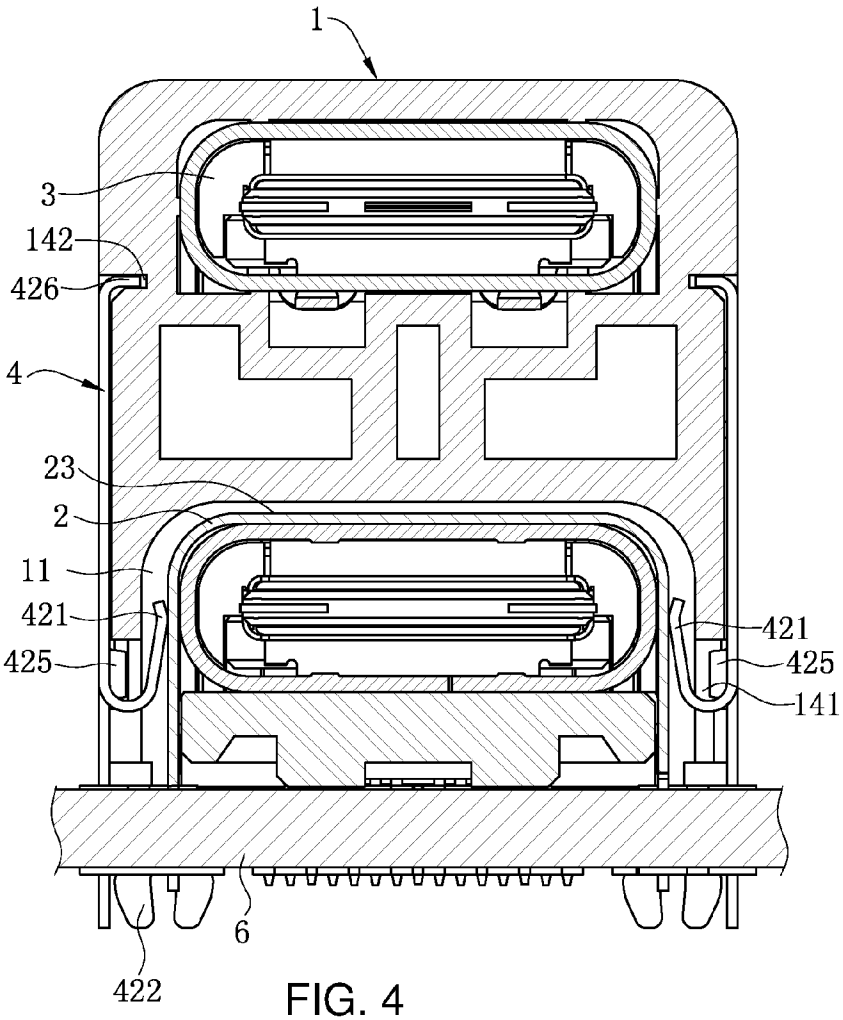
FIG. 4 is a sectional plane view of a front view of the electrical connector assembly according to one embodiment of the present invention.
Figure 5:
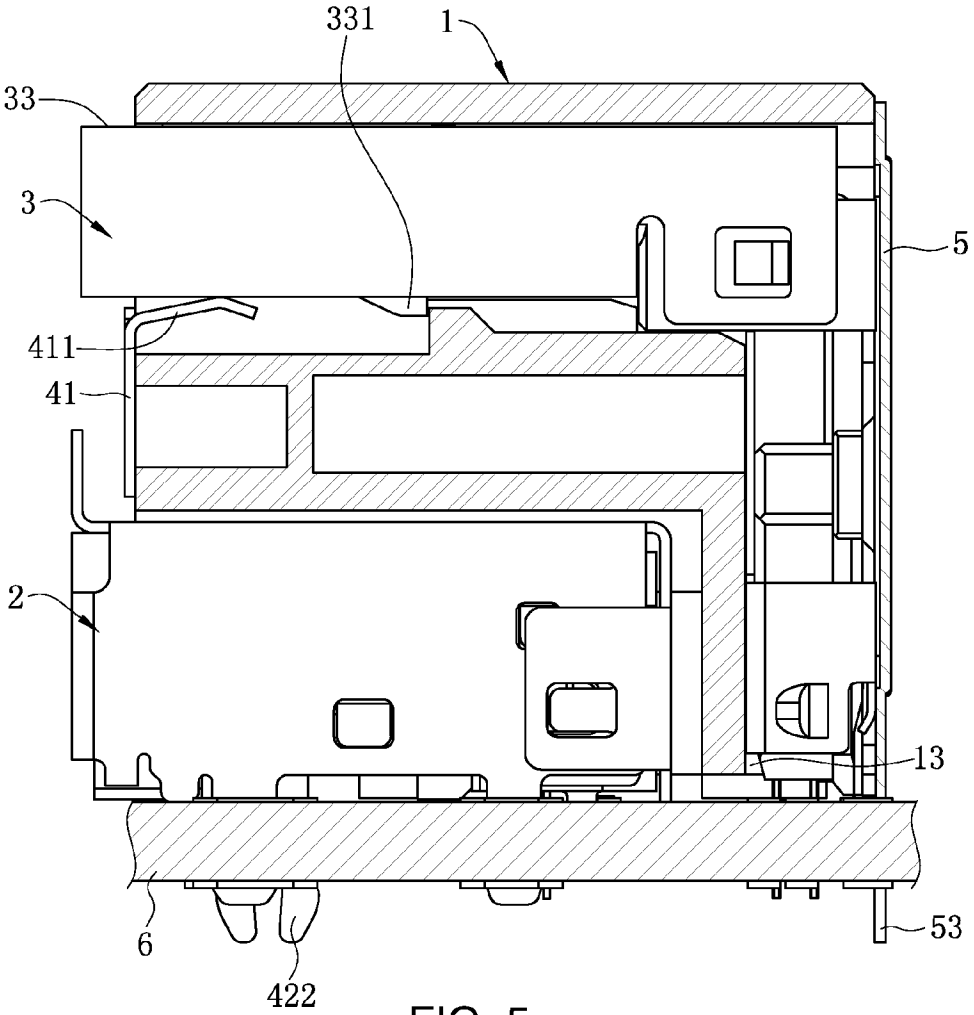
FIG. 5 is a sectional plane view of a right view of the electrical connector assembly according to one embodiment of the present invention.

The description will be made as to the embodiments of the present invention in conjunction with the accompanying drawings in FIGS. 1-5. In accordance with the purposes of this invention, as embodied and broadly described herein, this invention, in one aspect, relates to an electrical connector assembly.

In certain embodiments, an electrical connector assembly of the present invention is installed on a circuit board 6 and may be provided for two mating connectors to be inserted therein and connected. The electrical connector assembly includes an insulating body 1, a first connector 2 and a second connector 3 that are disposed in the insulating body 1, a metal member 4 connected to the first connector 2 and the second connector 3, and a back shielding casing 5 shielding a back end of the insulating body 1.

The insulating body 1 is provided with a first accommodating cavity 11 and a second accommodating cavity 12. The first accommodating cavity 11 is located below the second accommodating cavity 12. The first accommodating cavity 11 accommodates the first connector 2. The first accommodating cavity 11 has a plugging slot for the mating connector to be inserted therein, and an opening 111, provided below the first accommodating cavity 11, for the first connector 2 to be soldered onto the circuit board 6 is. The first accommodating cavity 11 has two opposite side walls 112. A front edge of each of the side walls 112 is provided with a notch 1121 in a direction close to the circuit board 6. The second accommodating cavity 12 accommodates the second connector 3, and the second accommodating cavity 12 is through from front to rear. The back end of the insulating body 1 is provided with a depressed portion 13. A front end of each side surface of each of two opposite sides of the insulating body 1 is provided with a groove 14. Each of the grooves 14 has a first snap-fit slot 141, a second snap-fit slot 142 and a protruding portion 143. Multiple positioning posts (not shown) and multiple bosses 15 are disposed below the insulating body 1. The positioning posts are inserted into the circuit board 6 to fix the insulating body 1, and the bosses 15 press a surface of the circuit board 6.

The first connector 2 includes a first body 21, multiple first terminals 22 disposed in the first body 21, and a first metal casing 23 wrapping the first body 21 and the first terminals 22. In this embodiment, the first connector 2 is of the USB C TYPE, and in others embodiments, the first connector 2 may be other types of connectors.

The second connector 3 includes a second body 31, multiple second terminals 32 disposed in the second body 31, and a second metal casing 33 wrapping the second body 31 and the second terminals 32. A tail portion of each of the second terminals 32 is disposed in the depressed portion 13 to position the second terminals 32. Two bumps 331 are disposed below the second metal casing 33. The bumps 331 and the bottom wall of the second accommodating cavity 12 are locked to fix the second metal casing 33, so as to prevent the second metal casing 33 from being unplugged or loosed by an exterior force. In this embodiment, the second connector 3 is of the USB C TYPE, and in others embodiments, the second connector 3 may be other types of connectors.

The metal member 4 is disposed at the outer side of the insulating body 1 and connects and conducts the first metal casing 23 and the second metal casing 33. The metal member 4 has a front plate 41 and side plates 42 respectively connected to two sides of the front plate. The front plate 41 is disposed at a front end of the insulating body 1, and the side plates 42 are disposed in the grooves 14 on the side surfaces of the two opposite sides of the insulating body 1. The front plate 41 is disposed between the first metal casing 23 and the second metal casing 33, and both the first metal casing 23 and the second metal casing 33 protrude forward from the front plate 41. A contact portion 411 extends from an upper side edge of the front plate 41 into the second accommodating cavity 12, the contact portion 411 is in contact with the second metal casing 33, and the contact portion 411 is located below the second metal casing 33.

An urging portion 421 extends downward from each of the side plates 42 and bypasses the corresponding notch 1121 or passes through the corresponding side wall 112 and is bent upward and extends into the first accommodating cavity 11, and the urging portion 421 is reversely bent and extends. The urging portions 421 draw close to each other and urge respectively two opposite sides of the first metal casing 23, so that contact between the urging portions 421 and the first metal casing 23 is more stable. Moreover, each of the urging portions 421 is located between the corresponding side wall 112 and the first metal casing 23, and the side corresponding wall 112 plays a role of limiting the urging portion 421, so that after being subject to a force, the urging portion 421 does not excessively approach in a direction toward the corresponding side plate 42, and is not easily deformed. After the urging portion 421 is subject to a force, the corresponding side wall 112 urges the urging portion 421, so that elastic fatigue does not easily occur in the urging portion 421. A grounding pin 422 extends downward from each of the side plates 42, and the grounding pins 422 are soldered onto the circuit board 6. In this embodiment, each of the grounding pins 422 is a harpoon pin, which helps the metal member 4 be locked onto the circuit board 6, and helps the metal member 4 be soldered and fixed. In other embodiments, the grounding pins 422 may be of a straight plate type. A gap 423 exists between each of the grounding pin 422 and the corresponding urging portion 421. Each of the gaps 423 enables the corresponding grounding pin 422 to be separated from the corresponding urging portion 421, and when the grounding pin 422 or the urging portion 421 is subject to a force, mutual affect between the grounding pin 422 and the urging portion 421 is reduced, so that performance of the metal member 4 is better.

A through-hole 424 is provided on each of the side plate 42, and the through-holes 424 are snap-fit respectively onto the protruding portions 143, so as to prevent the metal member 4 from being loosed and disengaged forward. A first buckling portion 425 and a second buckling portion 426 are disposed on each of the side plates 42, and the first buckling portions 425 and the second buckling portions 426 are correspondingly locked with the first snap-fit slots 141 and the second snap-fit slots 142. Each of the first buckling portion 425 is connected to the corresponding grounding pin 422, and the first buckling portion 425 and the corresponding urging portion 421 are located at a same height. When the urging portion 421 is subject to a force, the corresponding first buckling portion 425 firmly buckles the corresponding first snap-fit slot 141 to prevent the side plate 42 from expanding outward to loosen the metal member 4. When the urging portion 421 is subject to a force, the corresponding first buckling portion 425 firmly buckles the corresponding first snap-fit slot 141 to prevent the grounding pin 422 from expanding outward to disable under-plate soldering or prevent the grounding pin 422 from breaking or damage due to expanding outward caused by excessive violent force, thereby ensuring quality of the metal member 4. The second buckling portion 426 is disposed at an upper side edge of the side plate 42, so that the metal member 4 does not turn over due to force subjected to the urging portion 421, so as to improve the quality of the metal member 4 and ensure grounding performance thereof.

The back shielding casing 5 is disposed at a back end of the insulating body 1. The back shielding casing 5 has a main body portion 51, multiple buckling portions 52 located at two sides of the main body portion 51, and multiple soldering pins 53 located below the main body portion 51. The main body portion 51 shields tail portions of the second terminals 32. The buckling portions 52 are snap-fit onto the insulating body 1 to fix the back shielding casing 5. The soldering pins 53 are soldered to the circuit board 6 so that the back shielding casing 5 is grounded.

To sum up, certain embodiments of the electrical connector of the present invention, among other things, has the following beneficial advantages.

(1) The urging portions 421 draw close to each other and urge two opposite sides of the first metal casing 23, so that contact between the urging portions 421 and the first metal casing 23 is more stable.

(2) Each of the urging portions 421 is located between the corresponding side wall 112 and the first metal casing 23, and the side wall 112 plays a role of limiting the urging portion 421, so that after being subject to a force, the urging portion 421 does not excessively approach in a direction toward the side plate 42, and is not easily deformed. After the urging portion 421 is subject to a force, the corresponding side wall 112 urges the urging portion 421, so that elastic fatigue does not easily occur in the urging portion 421. Therefore, grounding/shielding performance of the urging portions 421 is stable.

(3) A gap 423 exist between each of the grounding pins 422 and the corresponding urging portion 421. The gap 423 enables the grounding pin 422 to be separated from the corresponding urging portion 421, and when the grounding pin 422 or the urging portion 421 is subject to a force, mutual affect between the grounding pin 422 and the corresponding urging portion 421 is reduced, so that performance of the metal member 4 is better.

(4) Each of the first buckling portions 425 is connected to the corresponding grounding pin 422, and the first buckling portion 425 and the corresponding urging portion 421 are located at a same height. When the corresponding urging portion 421 is subject to a force, the first buckling portion 425 firmly buckles the corresponding first snap-fit slot 141 to prevent the side plate 42 from expanding outward to loosen the metal member 4. When the corresponding urging portion 421 is subject to a force, the first buckling portion 425 firmly buckles the corresponding first snap-fit slot 141 to prevent the grounding pin 422 from expanding outward to disable under-plate soldering or prevent the grounding pin 422 from being from breaking or damage due to expanding outward caused by excessive violent force, thereby ensuring quality of the metal member 4.

(5) The second buckling portions 426 are disposed at an upper side edge of the side plates 42, so that the metal member 4 does not turn over due to force subjected to the urging portions 421, so as to improve the quality of the metal member 4 and ensure grounding performance thereof.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly comprising:

an insulating body provided with an accommodating cavity, the accommodating cavity having two opposite side walls, wherein each of the side walls is provided with a notch;

a metal member retained to an outside of the insulating body, and having two urging portions, wherein each of the urging portions extends around corresponding one of the side walls and bypasses corresponding one of the notches, and is bent and extends into the accommodating cavity; and a first connector disposed in the accommodating cavity, wherein the first connector has a first metal casing, the two urging portions urge two opposite sides of the first metal casing correspondingly, and each of the urging portions is located between the first metal casing and the side wall.

2. An electrical connection assembly comprising:

an insulating body provided with an accommodating cavity, the accommodating cavity having two opposite side walls;

a metal member retained to an outside of the insulating body, and having two urging portions, wherein each of the urging portions extends around corresponding one of the side walls and is bent and extends into the accommodating cavity; and a first connector disposed in the accommodating cavity, wherein the first connector has a first metal casing, the two urging portions urge two opposite sides of the first metal casing correspondingly, and each of the urging portions is located between the first metal casing and the side wall;

wherein the metal member further comprises a front plate and two side plates respectively connected to two sides of the front plate, and each of the urging portions extends from corresponding one of the side plates and bypasses corresponding one of the side walls to enter the accommodating cavity.

3. The electrical connection assembly of claim 2, wherein each of the urging portions extends downward from corresponding one of the side plates and is reversely bent into the accommodating cavity.

4. The electrical connection assembly of claim 2, wherein a grounding pin extends downward from each of the side plates, and a gap exists between each of the grounding pin and corresponding one of the urging portions.

5. The electrical connection assembly of claim 4, wherein a first buckling portion and a second buckling portion are disposed on each of the side plates, and the insulating body is provided with a first snap-fit slot and a second snap-fit slot that respectively correspond to each of the first buckling portions and each of the second buckling portions.

6. The electrical connection assembly of claim 5, wherein each of the first buckling portions is connected to corresponding one of the grounding pins, and each of the first buckling portions and corresponding one of the urging portions are located at a same height.

7. The electrical connection assembly of claim 2, wherein each side surface of the insulating body is provided with a groove, and each of the side plates is located in corresponding one of the grooves.

8. An electrical connector assembly comprising:

an insulating body provided with a first accommodating cavity and a second accommodating cavity, and the first accommodating cavity and the second accommodating cavity respectively accommodating a first metal casing and a second metal casing; and a metal member disposed at an outer side of the insulating body and connected to the first metal casing and the second metal casing, wherein the metal member has a front plate and two side plates connected to two sides of the front plate, an urging portion extends from each of the side plates and is bent and extends from the outer side of the insulating body into the first accommodating cavity, each of the urging portions urges a side of the first metal casing, and each of the urging portions is located between the first metal casing and the insulating body.

9. The electrical connection assembly of claim 8, wherein the first accommodating cavity has two opposite side walls, each of the side walls is provided with a notch, and each of the urging portions extends downward from corresponding one of the side plates, bypasses corresponding one of the notches, and is reversely bent into the first accommodating cavity.

10. The electrical connection assembly of claim 8, wherein the first accommodating cavity has two opposite side walls, each of the urging portions extends downward from corresponding one of the side plates, passes through corresponding one of the side walls and is reversely bent into the first accommodating cavity.

11. The electrical connection assembly of claim 8, wherein a contact portion extends from an upper side edge of the front plate into the second accommodating cavity, and the contact portion is in contact with the second metal casing.

12. The electrical connection assembly of claim 8, wherein a grounding pin extends downward from each of the side plates, and a gap exists between each of the grounding pins and corresponding one of the urging portions.

13. The electrical connection assembly of claim 12, wherein a first buckling portion and a second buckling portion are disposed on each of the side plates, and the insulating body is provided with first locking slots and second locking slots that correspond to the first buckling portions and the second buckling portions.

14. The electrical connection assembly of claim 13, wherein each of the first buckling portions is connected to corresponding one of the grounding pins, and each of the first buckling portions and corresponding one of the urging portions are located at a same height.

15. The electrical connection assembly of claim 8, wherein the front plate is located between the first metal casing and the second metal casing, and both the first metal casing and the second metal casing protrude forward from the front plate.

16. The electrical connection assembly of claim 8, wherein each of side surfaces of two opposite sides of the insulating body is provided with a groove, and each of the side plates is located in corresponding one of the grooves.

* * * * *